US008678693B2

(12) United States Patent
Sturgis et al.

(10) Patent No.: US 8,678,693 B2
(45) Date of Patent: Mar. 25, 2014

(54) BRUSH HEAD FOR USE ON A CONTAINER FOR DISPENSING A COMPOSITION

(75) Inventors: Thomas Arthur Sturgis, Mason, OH (US); Ali Abdelaziz Alwattari, West Chester, OH (US); David Matthew Groh, Lebanon, OH (US); Theresa Louise Johnson, South Lebanon, OH (US); Edward John Popiel, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 602 days.

(21) Appl. No.: 12/727,737

(22) Filed: Mar. 19, 2010

(65) Prior Publication Data

US 2010/0239358 A1 Sep. 23, 2010

Related U.S. Application Data

(60) Provisional application No. 61/162,252, filed on Mar. 20, 2009.

(51) Int. Cl.
*A47L 13/22* (2006.01)

(52) U.S. Cl.
USPC ..... 401/287; 401/286; 401/284

(58) Field of Classification Search
USPC ..... 401/284–288, 282
See application file for complete search history.

(56) References Cited

U.S. PATENT DOCUMENTS

| | | | | | |
|---|---|---|---|---|---|
| 299,144 | A | * | 5/1884 | Huntbatch | 401/15 |
| 1,810,074 | A | * | 6/1931 | Friedlander | 401/288 |
| 1,981,851 | A | | 11/1934 | Aten | |
| 2,034,661 | A | * | 3/1936 | McCauley | 401/285 |
| 3,309,727 | A | * | 3/1967 | Snodderly | 15/160 |
| 4,252,455 | A | | 2/1981 | de la Pena | |
| 4,603,992 | A | | 8/1986 | Kavoussi | |
| 4,753,547 | A | * | 6/1988 | Dodero | 401/190 |
| 4,772,148 | A | | 9/1988 | Buschemeyer | |
| 5,709,490 | A | * | 1/1998 | Dyas | 401/19 |
| 5,772,347 | A | | 6/1998 | Gueret | |
| 6,003,523 | A | | 12/1999 | Nettlefold | |
| 6,048,583 | A | * | 4/2000 | Waddell | 427/429 |
| 6,079,087 | A | * | 6/2000 | Cansler | 28/279 |
| 6,161,978 | A | * | 12/2000 | Dovellos | 401/288 |
| 6,755,585 | B2 | | 6/2004 | Gueret | |
| 7,125,189 | B2 | | 10/2006 | Gueret | |

(Continued)

FOREIGN PATENT DOCUMENTS

| | | | |
|---|---|---|---|
| DE | 727950 | C | 11/1942 |
| DE | 899789 | C | 12/1953 |

(Continued)

OTHER PUBLICATIONS

PCT International Search Report with Written Opinion in corresponding Int'l appln. PCT/US2010/02788 dated Aug. 6, 2010.

*Primary Examiner* — David Walczak
(74) *Attorney, Agent, or Firm* — Jay A. Krebs

(57) ABSTRACT

A brush for providing a composition to a surface. The brush includes a base and a plurality of bristles. The plurality of bristles have a distal end and a proximal end. The distal end is functionally attached to the base and the distal end has a greater bristle density than the proximal end. The plurality of bristles forms at least one flow path from the distal end towards the proximal end.

10 Claims, 4 Drawing Sheets

(56) References Cited

U.S. PATENT DOCUMENTS

| | | | |
|---|---|---|---|
| 7,325,993 | B2 | 2/2008 | Gueret |
| 2005/0045200 | A1 | 3/2005 | Zeunik |
| 2005/0102978 | A1 | 5/2005 | Gueret |

FOREIGN PATENT DOCUMENTS

| | | | |
|---|---|---|---|
| DE | 8811171 | U1 | 11/1988 |
| DE | 4016353 | A1 | 12/1990 |
| DE | 19811552 | A1 | 9/1999 |
| DE | 10306983 | A1 | 9/2003 |
| FR | 2582921 | A1 | 12/1986 |
| FR | 2919585 | | 2/2009 |
| GB | 2175799 | A | 12/1986 |
| GB | 2318725 | A | 5/1998 |
| GB | 2322797 | A | 9/1998 |
| JP | 2000/77767 | A2 | 6/2000 |
| WO | WO 00/49912 | | 8/2000 |

* cited by examiner

BRUSH HEAD FOR USE ON A CONTAINER FOR DISPENSING A COMPOSITION

CROSS REFERENCE TO RELATED APPLICATIONS

This application claims the benefit of U.S. Provisional Application No. 61/162,252 filed Mar. 20, 2009.

BACKGROUND OF THE INVENTION

Brushes of various materials and types have been known in the art. Brushes have been used to apply materials, smooth finishes, provide energy to surfaces, and the like. While there have been many uses of brushes, their basic design and configuration has remained fairly unchanged over time.

Cosmetic brushes are also prevalent within the brush industry. These are often used to apply compositions, including powders, liquids, and other forms of beautifying products, to the skin. Shave preparation brushes are also known in the brush industry. These brushes are used in combination with shave preparations to apply and "froth" these preparations by entraining air within the compositions. Typically, the best brushes are thought to be made of boar's hair. However, these cosmetic and shave brushes have problems, which result in inefficiencies and consumer negative responses.

Many brushes, including cosmetic and shave preparation brushes, contain bristles made of natural hair products, such as boar's hair. These brushes may produce an odor that is considered to be unacceptable by many consumers. Moreover, these brushes typically entrain the product meant to be applied within the brush. This entrainment of product results in unsatisfactory application of product, waste of usable product, as well as an increased opportunity for bacteria buildup.

Further, dispensing containers with brushes have also been disclosed. See, e.g., U.S. Patent Publ. No. 2009/0263175; 2009/0263174; and 2005/0045200; and U.S. Pat. Nos. 6,003,523; 4,252,455; and 4,603,992. These dispensing containers, however, typically require a plastic or rubber dispensing channel to direct composition from the container to the brush bristles. The composition dispensed from the channels tends to spread within the brush but may not reach the tip of the brush where it is most needed. As such, there is a need for a brush that provides for an improved user experience, while eliminating the negative features that have always been associated with brushes. The brush of the current invention solves one or more of these and other problems.

SUMMARY OF THE INVENTION

One aspect of the present invention provides for a brush head for use with a container for dispensing a composition, said brush head comprising: a base, and a plurality of bristles, said plurality of bristles having a distal end and a proximal end, wherein said distal end is attached to the base and said proximal end forms a skin contacting region; wherein the distal end has a greater bristle density than the proximal end; and wherein said plurality of bristles forms at least one flow path from said distal end towards said proximal end.

DETAILED DESCRIPTION OF THE INVENTION

Figure 1:
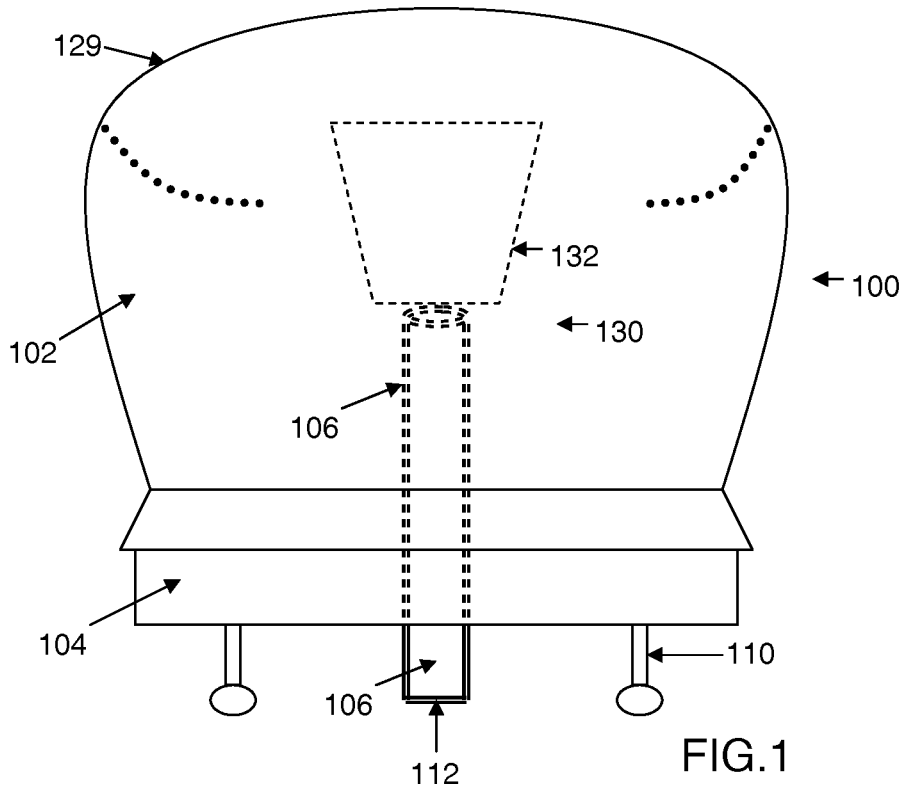
FIG. 1 illustrates a side planar view of a brush head in accordance with at least one embodiment of the present invention.
Figure 2:
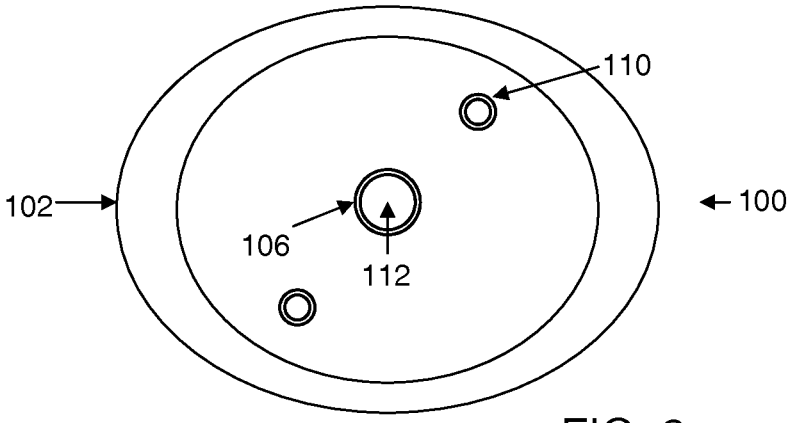
FIG. 2 illustrates the bottom view of the brush head shown in FIG. 1.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While the specification concludes with the claims particularly pointing and distinctly claiming the invention, it is believed that the present invention will be better understood from the following description.

The devices, apparatuses, methods, components, and/or compositions of the present invention can include, consist essentially of, or consist of, the components of the present invention as well as other ingredients described herein. As used herein, "consisting essentially of" means that the devices, apparatuses, methods, components, and/or compositions may include additional ingredients, but only if the additional ingredients do not materially alter the basic and novel characteristics of the claimed devices, apparatuses, methods, components, and/or compositions.

All percentages and ratios used herein are by weight of the total composition and all measurements made are at 25° C., unless otherwise designated. A degree is a planar unit of angular measure equal in magnitude to 1/360 of a complete revolution.

All measurements used herein are in metric units unless otherwise specified.

As used herein, the term "substantially non-parallel" means that the objects compared have a difference in angle of at least about 15 degrees.

As used herein, the term "substantially parallel" means that the objects compared have a difference in angle of less than about 15 degrees.

As used herein, the term "substantially perpendicular" means that the objects compared are within about 15 degrees from being perpendicular.

As used herein, the term "surface" means an area whereby the composition is capable of being applied. As it relates to shaving compositions, the surface relates to portions of the skin capable of growing hair, including the face, scalp, underarm, pubic area, and the like.

The current invention relates to a brush head for use with a package for dispensing a product comprising a base; a plurality of bristles, said plurality of bristles having a distal end and a proximal end, wherein said distal end is attached to the base; wherein the distal end has a greater bristle density than the proximal end; and wherein said plurality of bristles forms at least one flow path from said distal end towards said proximal end.

Without wishing to be bound by theory, it is believed that the bristle density being greater at the distal end than at the proximal end facilitates the transport of composition from the distal end to the proximal end of the bristles. This feature results in a brush that is easier to use, with reduce messiness. The brush of the present invention is also easier to clean, as only small amounts of composition are able to enter the distal end of the bristles, thus removing the need to remove these materials. As the proximal end is less dense, cleaning on this end is further facilitated by this end of the bristles.

Further, in one embodiment, the flow path is defined by a discrete region of low bristle population. A region of low bristle population means that within said discrete region, the number of bristles per area is measurably lower than the bristles per area surrounding at the region as the brush extends from the base towards the skin contacting region which is the proximal end of the bristles. In one embodiment, the number of bristles per area is at least about 20% less, alternatively at least about 40% less, alternatively at least about 50% less, alternatively at least about 75% less than the number of bristles per area surrounding the region. Bristle population can be calculated on by square mm or square cm of area. In one embodiment, the region of low bristle density is free or essentially free of bristles. By "essentially free of bristles" it is meant that no bristles for formed in the region. It will be understood by those in the art that bristles are flexible and can bend into the region intended as the flow path. Allowing bristles to bend into the flow path is within the scope of the invention. In one embodiment, the flow path maintains a substantially consistent shape from the base to the skin contacting region.

In one embodiment, the flow path also comprises one or more dispensing tubes which can extend for a portion of said flow path. In one embodiment the dispensing tube forms the portion of the flow path as it immediately exits the dispensing container and extends for some distance above the base but below the contacting region. Those of skill in the art will understand that the flow path can continue beyond the dispensing tube as the brush extends away from the base. Without intending to be bound by theory, it is believed by providing a flow path which is made of both a dispensing tube and a region of low bristle population, the brush head facilitates the transport of composition from the base to the skin contacting region. In one embodiment, the region of low bristle population is in fluid communication with said dispensing tube such that composition dispensed through said dispensing tube continues to travel the same general path away from the base. In one embodiment, the dispensing tube is made from an elastomeric material which is flexible, such as rubber.

In one embodiment, at least a portion of the dispensing tube can have an interior structure run for at least a portion of the length of the dispensing tube. Non-limiting examples of suitable interior structures includes one or more dividing wall, thereby creating two half circles within the tube, or three, or four passages within the dispensing tube. Without intending to be bound by theory, it is believed that providing said one or more dividing walls can help direct flow of the composition away from the base towards the exit orifice, ultimately towards the skin contact region of the brush head. In one embodiment, said one or more dividing walls can create a tube within a tube. This may be particularly useful if multiple types of compositions are used in the container.

Base

The base of the current invention can be made of any material capable of functionally attaching bristles. In one embodiment, the base is made from a material selected from plastic, metal, composites, porcelain, glass, or combinations thereof. One of ordinary skill would be readily able to select a material suitable for making a base.

The base of the current invention is functionally attached to the distal end of the plurality of bristles. One of ordinary skill recognizes that there are many attachment mechanisms that may be employed to fix the plurality of bristles to the base. It is contemplated that the bristles are attached to the base by mechanical, chemical, and/or heat based mechanisms. One of ordinary skill would readily know how to attach the bristles of the present invention to the base.

In one embodiment, the base is functionally attached to a container. The container of the present invention relates to any vessel that can hold a composition for an indefinite period of time. The container of the present invention may be made by any number of materials, including plastics, metals, and the like. The container contains any composition that is to be applied with the brush. In one embodiment, the brush is removably attached to the container. In such an embodiment, the composition is directly applied to the skin and/or the brushed is placed in the composition within the container and applied to the surface.

An alternate embodiment of the base comprises a dispensing device. The dispensing device is fluidly attached to the base and capable of transmitting a composition outside of the container through the base between the plurality of bristles whereby the composition is capable of being applied to a surface. In one embodiment, the dispensing device is capable of dispensing the composition in a direction that is substantially parallel to the plurality of bristles. In an alternate embodiment, dispensing device is capable of dispensing the composition in a direction that is substantially non-parallel to the plurality of bristles. Moreover, the dispensing device is capable of dispensing the composition in a direction that is substantially perpendicular to the plurality of bristles. It is believed that when the composition is dispensed in a manner substantially perpendicular to the plurality of bristles, the delivery of the composition within the bristles of the brush becomes more uniform in addition to providing the composition additional air entrainment opportunities. Further, the transport of the composition through the plurality of bristles is aided by the bristle density driving the composition to the proximal end of the plurality of bristles, as well as the hydrophobic nature of the bristles.

Brush Shape

The brush of the present invention has a shape that facilitates usage, particularly on the face. In one embodiment, the outer shape of the cross-section of the brush, as defined by determining the cross-section of the bristles parallel to the base of the brush, is oblong in shape. By being oblong in shape, the cross-section has a first dimension that is longer than a second dimension, e.g., an overall length longer than the width. Oblong shapes include oval, oblong circles, rectangles, ellipses, and the like. In another embodiment, the outer shape of the cross-section of the brush is a circle, square, or regular polygon. It is contemplated that the corners of any polygon could be rounded. Other shapes, such as a "D" shape are also contemplated.

In one embodiment the proximal end of the brush is substantially parallel to the base. In an alternate embodiment, the proximal end of the brush comprises its highest bristles substantially in the center. The bristles then decrease in height from the center toward the edges in a curvilinear, stepped, angled, and/or arched manner In one embodiment, the difference between the average height of the bristles in the center of the brush and the average height of the bristles on the edge of the brush is from about 0.1 inches to about 0.5 inches, in an alternate embodiment from about 0.1 inches to about 0.3 inches. It is believed that having bristles of decreasing height allows the user to vary the amount of bristles that contact the surface by varying the application force. Such a mechanism results in an increase in mechanical action, leading to increased lather generation by the brush.

It is also contemplated to have a substantially angled edge, such as a squared edge, on at least one portion of the brush. Such an edge is capable of providing increased control of the brush action by being shaped to enter into tighter portions of a surface.

Bristles

The current invention includes a plurality of bristles. These the distal end of the plurality of bristles is functionally attached to the base. In one embodiment, at least one of said plurality of bristles comprises a hydrophobic material. In another embodiment, at least one of said plurality of bristles comprises hydrophilic material. In yet another embodiment, the plurality of bristles comprises a material selected from the group consisting of a hydrophobic material, a hydrophilic material, and a mixture thereof. Particularly preferred materials would be those which are hydrophobic, especially when the composition is water based. Without wishing to be bound by theory, it is believed that the hydrophobic nature of the plurality of bristles, in combination with the plurality of bristles having a greater bristle density at the distal end than at the proximal end, work synergistically to transport composition toward the proximal end of the plurality of bristles and onto a surface. This composition transport results in an improved brush usage experience as well as a more efficient and clean brush operation.

In one embodiment, any hydrophilic material is selected to make the plurality of bristles. Hydrophilic plastics are well suited for the current invention. In one embodiment, nylon is a hydrophilic plastic utilized for the plurality of bristles. In one embodiment, the hydrophobic material used to make at least a portion of said at least one bristle is selected from the group consisting of nylon, a natural hair (including but not limited to badger hair), and polybutylene terephthalene. Other known brush bristle materials may also be used.

Regarding the use of bristles, material and physical properties of bristles can impact brush performance, including skin feel and latherability, for example. In one embodiment, the bristle diameters are from about 0.001 to about 0.01 inches, in an alternate embodiment from about 0.002 to about 0.006 inches, in alternate embodiment from about 0.003 to about 0.004 inches. The bristles of the present invention have an average length of from about 0.1 to about 1.3 inches, in an alternate embodiment from about 0.3 to about 1.0 inches, in an alternate embodiment from about 0.5 to about 0.9 inches. The sizing of the bristles should be such that the bristles should not fold over or collapse during use; while allowing the bristles to return to substantially their original shape.

In one embodiment, the brush comprises a recess at the skin contacting region of the brush similar to the cavity described in U.S. Patent No. 2005/0045200 to Zeunik. In one embodiment, the composition flow path extends from said base and discharges into said recess. The recess is a discrete region of the brush where the height of the underlying bristles is lower than the average length of the rest of the bristles forming the rest of the brush. As such, a recess in the brush is formed. Without intending to be bound by theory, it is believed that that allowing composition to travel from the container through the base and ultimately into the recess allows the user to dispense a desired amount of composition without fear that the composition will spill over or fall off the tip of the brush. In one embodiment, the recess is formed by crimping a plurality of said bristles such that they do not extend as far from the base as the bristles surrounding the recess. In another embodiment, the recess is formed by a combination of crimped bristles or relatively shorter bristles.

In one embodiment, the composition dispensing tube comprises a dispensing orifice which opens into the portion of said recess facing said base. The dispensing orifice can be formed by part of the dispensing tube or formed from the region of low bristle population. In one embodiment, the the recess has a depth of from about 0.010 inch to about 1 inch, alternatively from about 0.05 inches to about 0.5 inches, alternatively from about 0.2 inches to about 0.4 inches. Those of skill in the art will understand that the dimensions of the recess can be varied as long as the recess can act to receive a volume of composition prior to contact with skin. In one embodiment, the recess has a shape which is selected from the group consisting of a circle, ellipse, oval, triangle, square, rectangle, star, moon, a letter or number, and so forth. In one embodiment, the shape of the recess is generally the same as the shape of the brush.

In one embodiment, the brush head had a central axis, and a cross sectional plane which is perpendicular to said central axis, wherein the cross sectional plane defines a recess cross section area and a brush cross section area, wherein the recess cross section area is from about 10% to about 75% of said brush cross section area, alternatively from about 25% to about 50%, alternatively from about 30% to about 40%.

In one embodiment, the plurality of bristles forms said fluid flow path. In one embodiment the fluid flow path comprises a dispensing tube, a region which is free or essentially free of bristles, or a combination thereof.

Various treatments of the proximal end of the plurality of bristles are contemplated for use with this brush. In one embodiment, end rounding, tipping, tapering, and the like are used to provide a user acceptable feel to the plurality of bristles.

It is contemplated that bristles of various hues and/or colors can utilized within brush. For example, colors may serve the function of showing where bristles of increasing and/or decreasing hardness are. Colors may also be used to indicate brand, brand name, style, and/or other aesthetic measures. Color may also be used to indicate the benefit of the associated composition, e.g., green bristles for indicating aloe, and the like.

Bristle Density

The brush of the present invention comprises a plurality of bristles, wherein the bristle density of the distal end is greater than the bristle density of the proximal end. The bristle density is determined by determining the sum of the cross-sectional area of the individual bristles and dividing it by the cross-section defined by the outermost bristles, which inherently includes void space between the bristles; then determining the percentage.

As an exemplary calculation, for a circular patch having a 0.2 inch radius containing 10,000 bristles, each bristle having a diameter of 0.002 inches, the bristle density would be calculated as follows:

0.002 inch diameter/2=0.001 inch radius
(radius of one bristle)
pi*0.001^2=0.00000314 inches^2
(cross-sectional area of one bristle→pi*(bristle radius)^2)
0.00000314*10,000=0.0314 inches^2
(cross-sectional area of 10,000 bristles→cross-sectional area of single bristle*the total number of bristles)
Pi*0.2^2=0.126 inches^2
(total area including bristles and void areas→pi*(radius of circular patch)^2)
0.0314/0.126*100=25%
(bristle density→cross-sectional area of 10,000 bristles/total area*100)

In one embodiment, the bristle density is greater at the distal end than it is at the proximal end. In one embodiment, the bristle density at the distal end of the plurality of bristles is from greater than 30 to about 80%, in an alternate embodiment from about 35 to about 70%, in an alternate embodiment from about 40 to about 60%, in an alternate embodiment from about 45 to about 55%. In one embodiment, the bristle density at the proximal end of the plurality of bristles is from 10 to at most 30%, in an alternate embodiment from about 15% to about 28%, in an alternate embodiment from about 19 to about 26%.

One mechanism to create additional voids within the bristles is to splay or flair out the bristles. In one embodiment, splay is created by utilizing wavy or crimped bristles as at least part of the plurality of bristles. Crimped bristles are bristles having a substantially periodic waveform with a crimp depth (peak to peak amplitude, from peak to trough) and crimp frequency. The crimped bristle comprises a crimp depth from about 0.005 inch to about 0.03 inches, alternatively from about 0.010 inch to about 0.020 inch. The crimped bristles comprise a crimp frequency of from about 2 to about 10 crimps per inch, alternatively from about 3 to about 7 crimps per inch.

Without wishing to be bound by theory it is believed that the larger space between crimped bristles allows each bristle to fluctuate further when the brush is being rubbed against the intended surface. This space allows the bristles to provide increased mechanical action and enhances the aeration of the composition. When used with a shaving composition, this mechanical action crates additional lather, lifts the hair on the surface for easier cutting, and aids exfoliation of the skin.

Composition

The composition of the present invention comprises any composition capable of being applied and/or distributed with a brush. In one embodiment, the compositions of the present invention include personal care compositions, including cosmetics, lotions, body washes, shampoos, shave preparations including but not limited to gels, foams, oils, sprays aerosol and non-aerosol formulations, and creams, and the like. Examples of these and other suitable compositions are known in the art and are available commercially. The compositions may further comprise aerosol, pressurized gas, mechanically pressurized, and/or non-pressurized compositions. Shave preparations of the gel, foam, and creamy types are also contemplated.

Exemplary brush heads for use with composition dispensing devices are illustrated in FIGS. 1-9. For FIGS. 1-2 the brush heads 100 has a plurality of bristles 102 and a base 104. The bristles form a skin contact region 129 which is opposite said base. In the illustrated embodiment, the brush 100 comprises a dispensing tube 106 that is fluidly connected to the base 104 and capable of transmitting a composition outside of the container through the base 104 between the plurality of bristles 132. Composition flowing through said dispensing tube and the region of the plurality of bristles forms the flow path 130. Although FIG. 1 shows the dispensing tube flowing into the brush, the fluid flow path can be made entirely of the region of bristles. In one embodiment, the region of bristles 132 is a region of low bristle population as defined above. The dispensing device 106 comprises at least one entrance orifice 112 and at least one exit orifice 108. Stabilizers 110 can be utilized to secure the base 104 of the brush 100 to a container (not shown).

Figure 3:
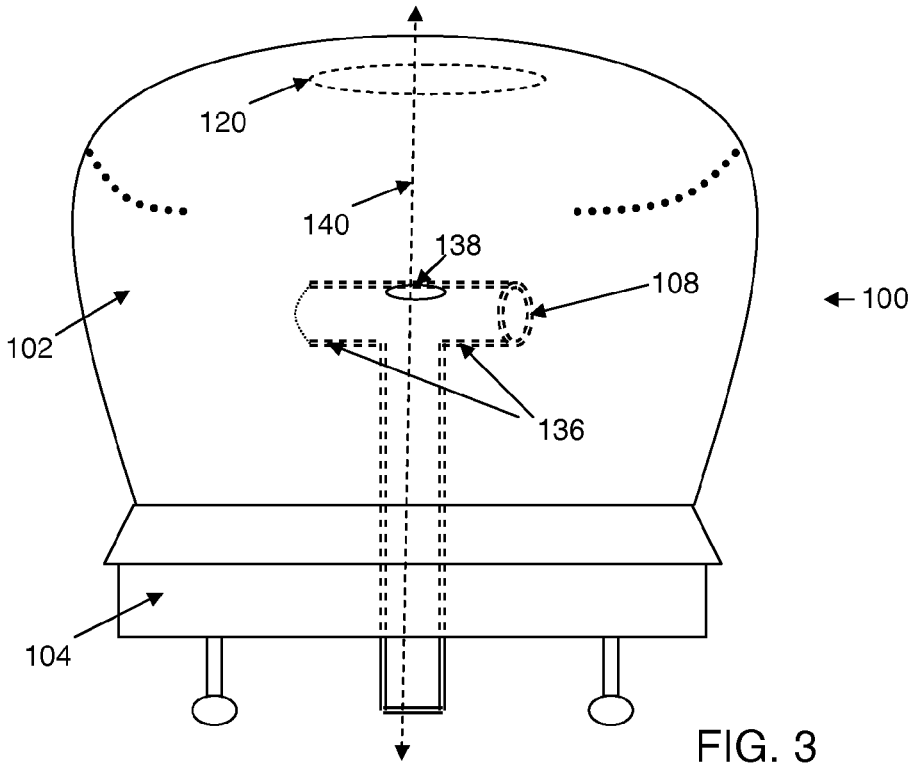
FIG. 3 illustrates a side planar view another brush head in accordance with at least one embodiment of the present invention.
Figure 4:
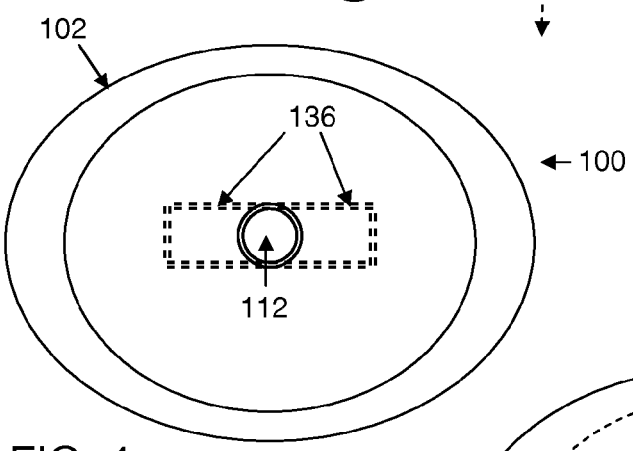
FIG. 4 illustrates the bottom view of the brush head shown in FIG. 3.
Figure 5:
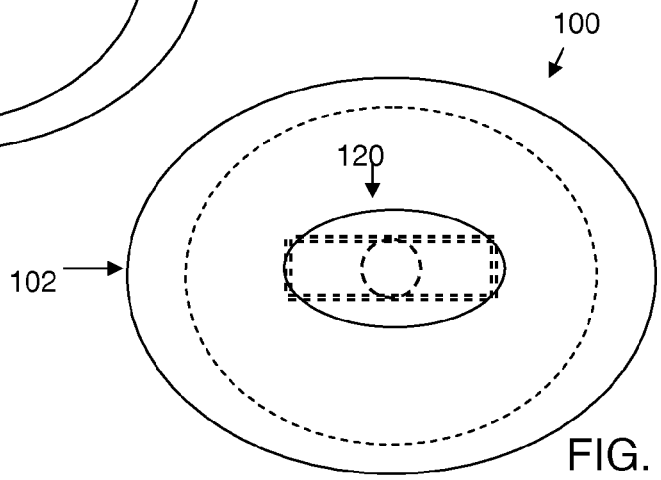
FIG. 5 illustrates the top view of the brush head shown in FIG. 3.

FIG. 3 shows another embodiment, where the dispensing tube comprises a central axis 140. At least a portion of said dispensing tube is not parallel to said central axis. In one embodiment, a portion of the dispensing tube forms an angle of from abut 0° to about 90°, or from about 30° to about 60, or about 45°, with said central axis. The dispensing tube shown in FIG. 3 includes two dispensing arms 136 which form roughly 90° with said central axis. In one embodiment, more than two dispensing arms are included. Further, the dispensing tube can also include additional exit orifice 138 which can be positioned anywhere along said dispensing tube such that composition dispensed will be able to travel through said brush. As explained above, when a dispensing tube is provided in the brush, the area above said dispensing tube, would typically be free of any bristles. In FIG. 3, the area above said dispensing arms would be free of bristles because any bristles formed there below would need to be pushed out of the way to accommodate the dispensing arms. As such, the skin contacting region can have a region of low bristle population 120 generally above the dispensing tube and/or dispensing arms. The bristle density at the proximal end would still be lower than the bristle density at the distal end. FIG. 4 shows a bottom view of the brush head of FIG. 3. FIG. 5 shows a top view of that same brush head, showing the region of low bristle population 120 being visible from the top and potentially exposing said dispensing arms and/or dispensing tube.

Figure 6:
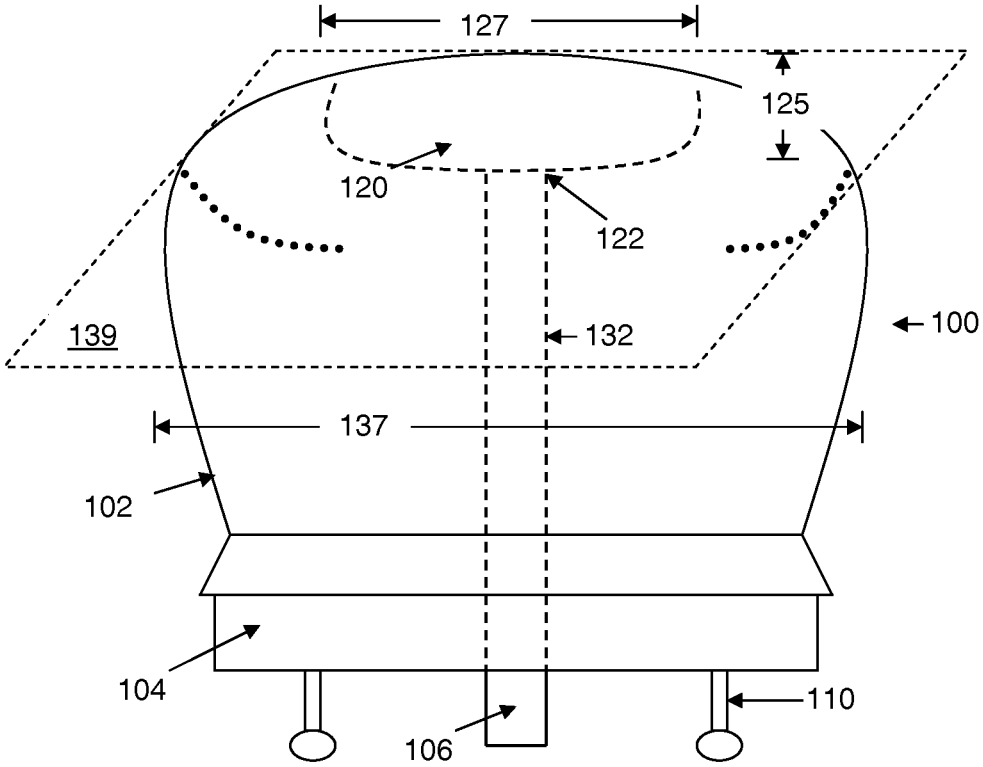
FIG. 6 illustrates a side planar view another brush head in accordance with at least one embodiment of the present invention.
Figure 7:
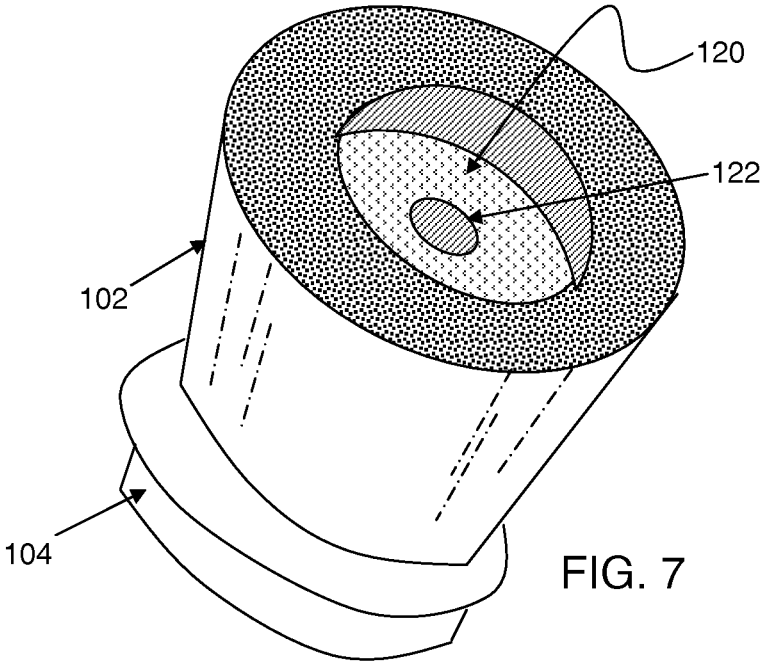
FIG. 7 illustrates an elevated perspective view of the brush head shown in FIG. 6.

FIG. 6 shows a side view of yet another embodiment of the present invention, wherein the plurality of bristles 102 forms a flow path 132 which leads away from said base but is in fluid communication with a dispensing tube 106 which would be in fluid communication with a composition present within a container. Flow path terminates at exit orifice 122 allowing dispensed fluid to sit in recess 120. The brush has a cross section plane 139 which is perpendicular to said central axis, forming both a cross section area for the brush as well as the recess. The recess has having a cross section area 127 with a specific cross sectional area. In one embodiment, the recess cross section area is from about 10% to about 75% of said brush cross section area 137. FIG. 7 shows an angled view of the same brush head shown in FIG. 6.

Figure 8:
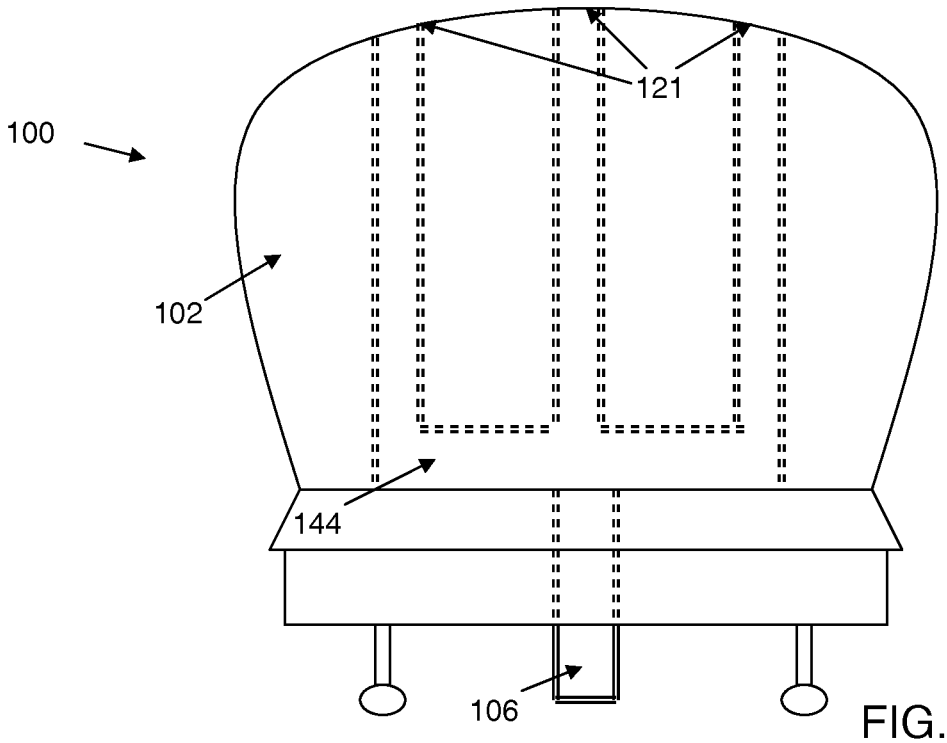
FIG. 8 illustrates a side planar view another brush head in accordance with at least one embodiment of the present invention.
Figure 9:
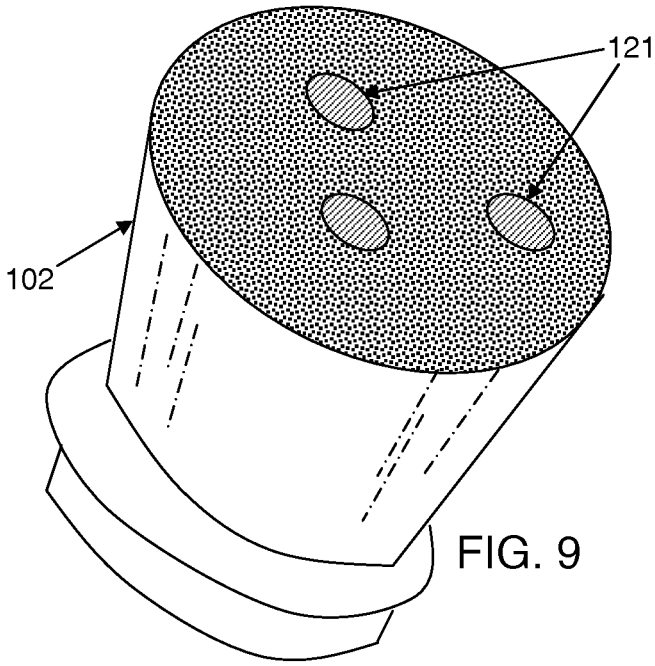
FIG. 9 illustrates an elevated perspective view of the brush head shown in FIG. 8.

FIGS. 8 and 9 provide side and angled views of yet another brush head 100 in accordance with at least one embodiment of the present invention. Shown here is a plurality of bristles 102 forming multiple flow paths, in this case three, wherein each flow path forms an exit orifice 121. In one embodiment, the area of the flow path which allows for lateral movement of the composition, 144, can be present above or below the base. Preferably the lateral portion of the flow path is below the base so to minimize impact on bristle placement as they extend away from said base.

Figure 10:
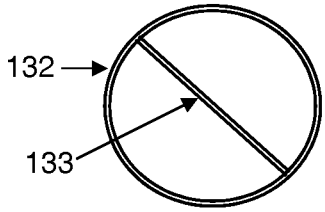
FIG. 10 illustrates a top view of a dispensing tube which can be used in a brush head in accordance with the present invention.
Figure 11:
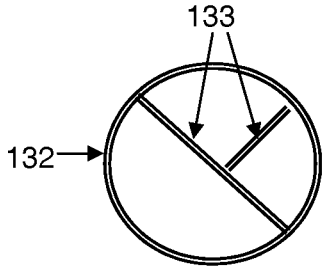
FIG. 11 illustrates a top view of another dispensing tube which can be used in a brush head in accordance with the present invention.

FIGS. 10 and 11 show top planar view of two types of dispensing tubes suitable for use with the present invention. The dispensing tubes 132 have interior dividing walls 133 which can be straight walls or can form concentric tubes, one within another. Further, although the dispensing tubes are shown to be circular, non circular shapes can also be used, such as squares, triangles, and so forth. In one embodiment, the dispensing tube is free of any interior walls.

Another embodiment of the present invention provides for a brush for providing a composition to a surface comprising: a base; a plurality of bristles, said plurality of bristles having a distal end and a proximal end, wherein said distal end is functionally attached to the base; wherein the distal end has a greater bristle density than the proximal end.

Another embodiment of the present invention provides for a brush, wherein the distal end has a bristle density from about 35% to about 70% or from about 45% to about 50%. Another embodiment of the present invention provides for a brush, wherein the plurality of bristles comprises at least one crimped bristle. Another embodiment of the present invention provides for a brush, wherein the at least one crimped bristle comprises a crimp depth from about 0.010 inch to about 0.020 inch and a crimp frequency of from about 3 to about 7 crimps per inch. Another embodiment of the present invention provides for a brush, wherein the plurality of bristles comprises a bristle resistance of from about 1 to about 6 grams. Yet another embodiment provides for brush, wherein the plurality of bristles is hydrophobic and can be made of nylon.

Yet another embodiment provides for a brush for providing a composition to a surface comprising: a base; a plurality of bristles, said plurality of bristles having a distal end and a proximal end, wherein said distal end is functionally attached to the base; wherein the distal end has a bristle density of greater than 30% to about 80%; wherein the proximal end has a bristle density of from about 10% to at most 30%. In one embodiment, the brush has the distal end with a bristle density from about 35% to about 70%, or from about 45% to about 50%. In one embodiment, the plurality of bristles comprises at least one crimped bristle. In one embodiment, the plurality of bristles comprises a bristle resistance of from about 1 to about 6 grams. The plurality of bristles can be hydrophobic and can be made of nylon In another embodiment, the brush comprises: a base; a plurality of bristles, said plurality of bristles having a distal end and a proximal end, wherein said distal end is functionally attached to the base; a dispensing device fluidly engaged to the base, capable of allowing the composition to flow through the base; wherein the distal end has a bristle density of from greater than 30% to about 80%; wherein the proximal end has a bristle density of from about 10% to at most 30%. In one embodiment, the dispensing device is capable of dispensing the composition in a direction that is substantially non-parallel to the plurality of bristles. In another embodiment, the dispensing device is capable of dispensing the composition in a direction that is substantially perpendicular to the plurality of bristles. In yet another embodiment, the distal end has a bristle density from about 40% to about 60%.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

It should be understood that every maximum numerical limitation given throughout this specification will include every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A brush head for use with a container for dispensing a composition, said brush head comprising:

a) a base;

b) a plurality of bristles, said plurality of bristles having a distal end and a proximal end, wherein said distal end is attached to the base and said proximal end forms a skin contacting region, wherein the distal end has a greater bristle density than the proximal end, wherein said plurality of bristles forms at least one flow path from said distal end towards said proximal end and a recess in the proximal end, and wherein said plurality of bristles comprises at least one crimped bristle; and c) a dispensing tube comprising at least one interior dividing wall, wherein the dispensing tube is disposed within the flow path and comprises at least one exit orifice which opens into the recess.

2. The brush head of claim 1, wherein the at least one crimped bristle comprises a crimp depth from about 0.010 inch to about 0.020 inch and a crimp frequency of from about 3 to about 7 crimps per inch, as measured from the proximal end of said brush head.

3. The brush head of claim 1, wherein the recess has a depth of from about 0.010 inch to about 1 inch.

4. The brush head of claim 1, wherein the brush head has a central axis, and a cross sectional plane which is perpendicular to said central axis, wherein the cross sectional plane defines a recess cross section area and a brush cross section area, wherein the recess cross section area is from about 10% to about 75% of said brush cross section area.

5. The brush head of claim 1, wherein at least one of said plurality of bristles is hydrophobic.

6. The brush head of claim 1, wherein at least one of said plurality of bristles comprises a material selected from the group consisting of: nylon, a natural hair, and polybutylene terephthalene.

7. The brush head of claim 1, wherein the distal end has a bristle density of greater than about 30% to about 80%.

8. The brush head of claim 1, wherein the proximal end has a bristle density of from about 10% to about 30%.

9. The brush head of claim 1, wherein said brush head is in fluid engagement with a container forming a flow path through said base into said flow path.

10. The brush head of claim 1, wherein said brush head is in fluid engagement with a container forming a flow path through said base into said dispensing tube.

* * * * *